US005732760A

United States Patent [19]

Pattison

[11] Patent Number: 5,732,760

[45] Date of Patent: Mar. 31, 1998

[54] WEATHER- OR INSECT-PROOFING COVER

[75] Inventor: John J. Pattison, Troy, N.Y.

[73] Assignee: James J. Devine, Valley Falls, N.Y.

[21] Appl. No.: 725,487

[22] Filed: Oct. 4, 1996

[51] Int. Cl.[6] ..... A47G 5/00

[52] U.S. Cl. ..... 160/371; 160/381; 160/392; 52/656.9; 52/656.7; 52/656.6

[58] Field of Search ..... 160/371, 381, 160/377, 392; 52/656.9, 656.7, 656.6; 49/74.1, 504; 403/231, 401, 402, 205

[56] References Cited

U.S. PATENT DOCUMENTS

| | | | |
|---|---|---|---|
| 1,232,511 | 7/1917 | Doty | 160/395 |
| 2,666,508 | 1/1954 | Nardulli | 52/656.6 X |
| 2,804,139 | 8/1957 | Pfau | 160/372 |
| 3,143,165 | 8/1964 | Lewis et al. | 160/371 X |
| 3,239,891 | 3/1966 | Gardner | 52/656.9 X |
| 3,885,335 | 5/1975 | Egermayer | 40/125 G |
| 4,127,156 | 11/1978 | Brandt | 160/371 X |
| 4,195,681 | 4/1980 | Douglas et al. | 160/371 |
| 4,341,255 | 7/1982 | Mock | 160/369 |

FOREIGN PATENT DOCUMENTS

| | | | |
|---|---|---|---|
| 223054 | 7/1959 | Australia | 52/656.6 |
| 1512489 | 2/1989 | France | 52/656.6 |
| 2810392 | 9/1979 | Germany | 160/371 |

*Primary Examiner*—Blair Johnson
*Attorney, Agent, or Firm*—Fredric Morelle

[57] ABSTRACT

A frame construct for holding at least one planar mesh or membrane in set-apart relationship from a structural port (a1). Individual frame pieces, top, bottom and sides, are cut to desired lengths and joined to form a glazable frame. Shapes other than of rectangular geometry are obtainable through use of variously angled joiners. Peripheral grooving on both frame faces is receptive of a spline that secures the planar mesh or membrane to the frame, which is then dogged to or otherwise secured in place on/over an opening such as a window, door or the like. Corner elements of the construct also serve as joiners; and, one spline may also comprise a weather strip.

14 Claims, 2 Drawing Sheets

WEATHER- OR INSECT-PROOFING COVER

BACKGROUND OF THE INVENTION

1. Field of the Invention

This invention relates generally to storm- and insect-proofing covers for windows, doors or similar portals. In particular, it inculcates improvements, over conventional covering adjuncts, that consist of a combination of custom-sized frame members which are cojoined to form a frame that readily accepts up to two glazing/ netting fabrics, while retaining its relatively thin, planar and light-weight character.

2. Relevent Art

Window or door coverings, as adjuncts to glazed or solid, opaque devices, have been a constantly evolving art. Storm- or insect-proofing apparata have been created in wood, metal and fiberglass or plastic embodiments that incorporate screen mesh, glazing (rigid or flexible) or both. Numerous means have been used to realize the aforementioned combinations and, by in large, have often incorporated techniques and/or devices that offer greater ease in installation, more durability or higher efficiency. Also high on the list of desirable characteristics are low cost and unobtrusiveness, if not simply good looks. Since the preeminent element of such an adjunct is a frame, my searches of catalogs and, in particular, U.S. Patent Office files have revealed noteworthy relevant art.

U.S. Pat. No. 3,885,335 shows a sign- and frame-holding apparatus having a capturing or holding member pivotally juxtaposed against a frame. A plurality of clips is used to secure perimetric portions of the holding member to the frame perimeter. The spline-emulating member is permanently attached to the holding member, but is incompressible, requiring the receiver (of the spline) to be non-rigid.

A storm-window disclosure, U.S. Pat. No. 2,804,139 ('139) shows a frame having extensible or telescoping members with a cross-section resembling a T. The cross bar of the T is recurred so as to receive a spline at each recurred portion. In assembly, the splines run parallel to each other capturing a plastic sheet on each face of the frame. The parallel splines are hidden from a face-on viewing by the recurved crossbar arms of the T. The upright or base of the T forms the visible outer periphery of the frame which is secured within a window frame by a plurality of clips. U.S. Pat. No. 4,341,255 shows frame internal joiners, similar to those of U.S. Pat. No. 3,885,335, in function, and employs rigid spline-receiving means. U.S. Pat. No. 1,232,511 shows a T form in sectional view in a frame similar to that in '139.

Innovative and highly utilitarian though the aforementioned patents may be, they all, to some degree, lack attributes which I sought to develop in my invention: simplicity and ease assembly, fitting and installation; and light-weight rigidity and dual funtionality of one or more of the elements.

3. Incorporation by Reference

The previously disclosed pieces of relevant art: U.S. Pat. Nos. 4,341,255 (Abstract and FIGS. 1–5); 3,885,335 (FIGS. 1–5); 2,804,139 (Columns 1, 2 and FIGS. 1–4); and 1,232,511 (FIGS. 4–8) are hereinafter incorporated by reference.

SUMMARY OF THE INVENTION

I have overcome the limitations of the relevant art and acquired the attributes defined above by devising a frame construct for holding one or more membranes or screens in order to provide a protective barrier against drafts or insects. Frame members, extruded from aluminum or high density plastics are cut to desired lengths and joined by joiner or connector elements that serve as both corners and couplers of the frame. Frame members, in cross-section, define a quadrilateral projecting T flange from one side. The frame is assembled with the T shape directed inward of the frame periphery, so that compressible spline-receiving grooves thus formed are disposed continously on both faces of the frame construct. At least one membrane, such as a sheet of plastic or mesh fabric, is placed over the frame and secured by a compressible spline that can extend-out of the grooving and serve also as a seal when the frame is secured to the peripheral frame of a window, portal or door. Alternatively, surface sealing medium, such as fibre or a resilient grommet, is applied to the reverse (window-contacting) face of the invention frame construct; and, the obverse spline, if used, is depressed fully into the grooving. To removably secure the invention to the window, etc. frame, I use screws, dogging clamps or other conventional clamping devices. Should the above window attachment means be eschewed, the construct may be press-fitted into the sash frame against the lower sash with sealing effected by placement of the aforementioned surface sealing medium (weather strip) on the outer periphery of the construct.

Greater understanding and appreciation of my invention will be had by the reading of the more detailed description, below.

DETAILED DESCRIPTION OF THE PREFERRED EMBODIMENT

Since this invention is an improvement over other forms of the art, I will first set forth a few definitions for the sake of consistency.

Definitions

Construct means the whole of anything that is assembled from its constituent parts;

glazing, which normally means to apply a glaze or gloss to a frame, shall also mean to apply any fabric or film, flexible or not, to such a frame;

protective refers to the quality of protecting against intrusion by elements or creatures; and flange means a conterminous margin, of any cross-section, running with an elongated strip or member.

Figures 1, 2, 3, 4:
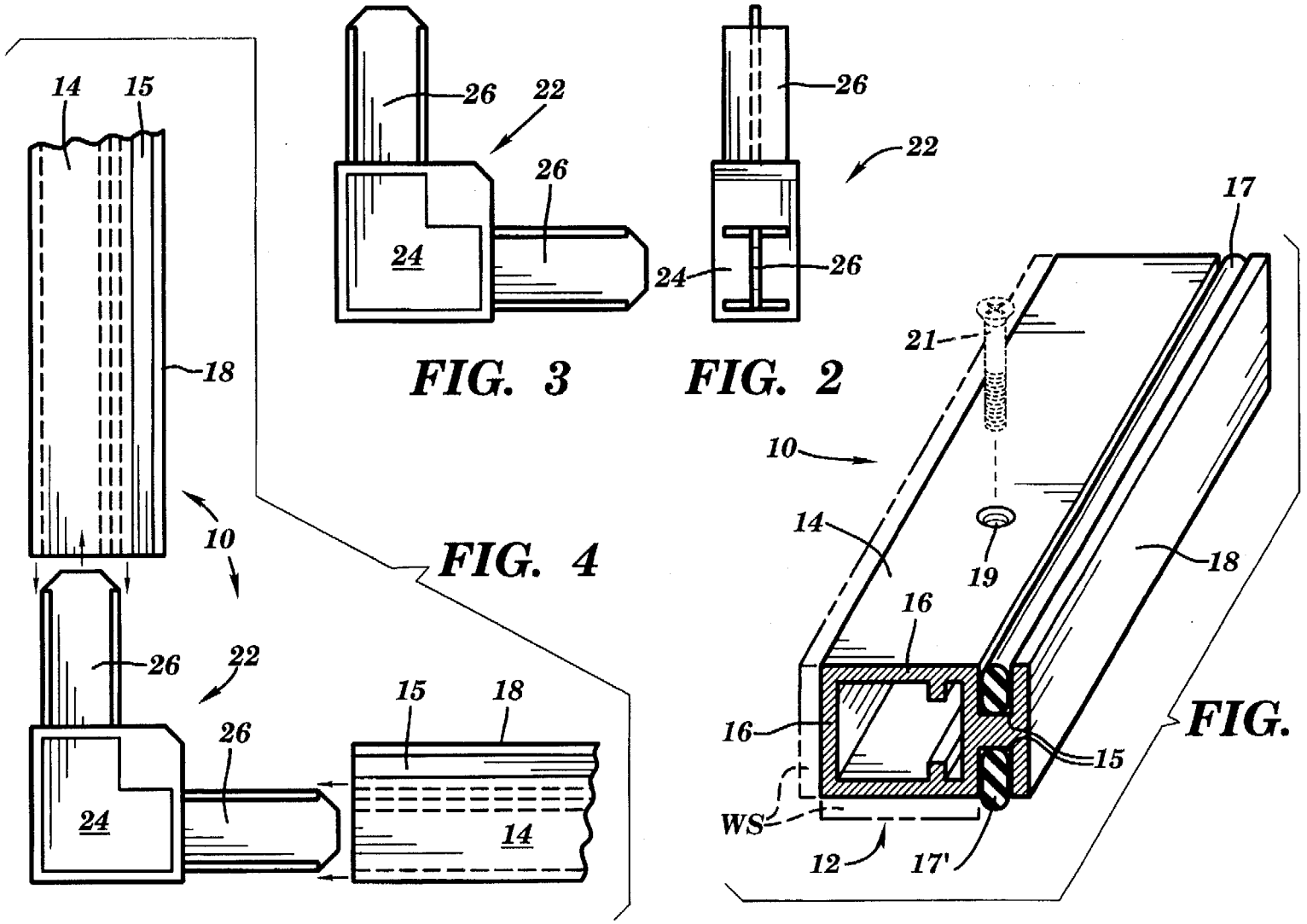
FIG. 1 is an isometric drawing of a part of a frame member containing spline members.
FIGS. 2 and 3 are orthogonal views of a joiner-corner element.
FIG. 4 is an assembly illustration of the elements of FIGS. 1, 2 and 3.

Referring particulary now to FIG. 1, I have depicted in a partial isometric drawing, an end 12 of a frame member 10. The frame member 10 is an elogate element comprised of a strip of material 14 that, in cross section, is a hollow quadrilateral 16 projecting from off one side thereof a T flange 18 and forming two parallel groovings 15. Interior lands 20 within the member 10 are used, in lieu of grooves, to cooperate with member 10 joiner 22 devices of FIG. 2 by capturing the leg extensions 26. When window, portal or door is to be afforded a protective barrier, it must be determined whether the frame is to be fitted into the window's, etc. frame or onto it. The invention frame, the construct C (see FIG. 5) is then built up of custom-cut frame members 10 and assembled by use of member end 12-insertable joiners 22. The frame members, which can be extruded from light-weight metal or high-density, rigid plastic such as polyvinylchloride (PVC), are joined to the desired size and geometry with the T flange 18 forming the inner perimeter.

FIGS. 2 and 3 are an orthograpic pair of illustrations showing a dual purposed joiner 22. Not only does it join two members 10 (in the preferred embodiment) but it emulates the frame member at points of junction, here forming a cornerpiece. The corner 24 is of a width and thickness equal a frame member. Its projecting elements 26 are insertable into the ends 12 of the two members (or more) that are joined. The cross-sectionally H-shaped projecting elements or legs 26 are captured between sides of the frame member 10 and its interior lands 20. The foregoing assembly is shown in FIG. 4. Those of ordinary skill will readily note that, if cross members are to be employed in this construct, T and X or + shaped joiner intersectors (not shown) must be used in addition to the L shaped joiners 22. These would be combinations of corners 24 and two or more projections 26.

FIG. 4 illustratively reiterates the foregoing assembly, showing members 10 connected by inserting the projecting legs 26 of joiners 22 into (ends of) two members. Note that T flange 18 will form an interior perimeter of the frame construct and, with that, a continuous grooving 15 (see also FIG. 1) results, on the frame faces, which is receptive of a fabric/membrane and spline 17.

Figure 6:
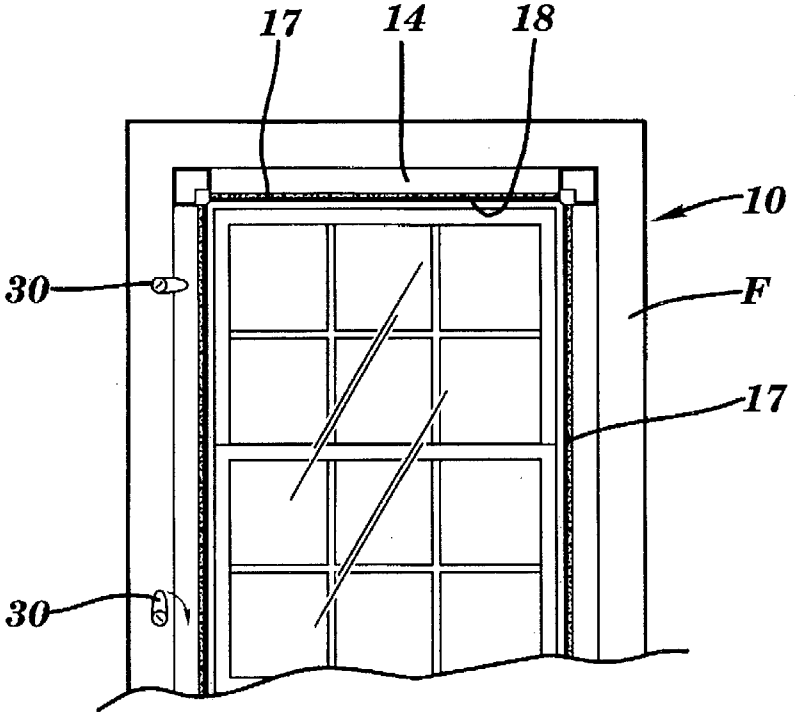
FIG. 6 shows the invention in frontal elevation.
Figure 5:
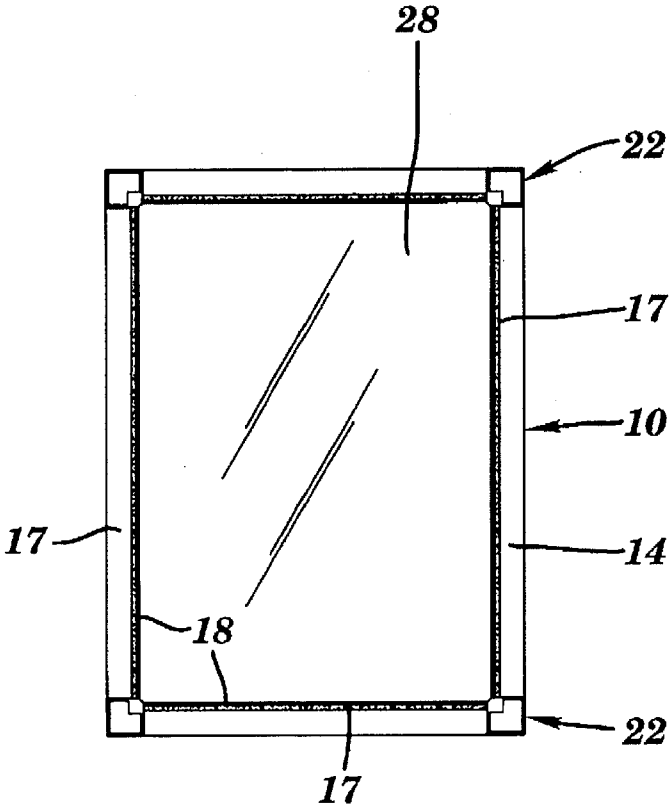
FIG. 5 is an illustration of the frame assembled with a spline-captured membrane.

Finally, FIGS. 5 and 6 show, respectively, a completed, glazed 28 frame construct and the unit placed over a window, etc. frame F. In the first of these, the glazing, is transparent film 28 held in place or captured by a spline 17 (see also FIG. 1). The construct C is secured and sealed to, or into, the frame F. Alternate securing and sealing apparatus are now discussed with reference back to FIG. 1.

If construct securment is to be on a window, etc. frame F, two different splines can be used as shown in FIG. 1. Spline 17, shown in the obverse groove 15 is flush with the surface of frame member 10. Spline 17' is of greater diameter and protrudes from groove 15' allowing its use as a sealing grommet when the construct is secured to the window, etc. frame F. In lieu of dogs 30, screws 21 may be inserted in predrilled holes 19 around the frame margins 14 (external) and the construct secured to frame F. Alternate to the disclosed sealing spline 17', conventional weather stripping WS may be used at construct C and frame F contact margins. Its use is well known in the art.

It should be also understood that the frame F, in addition to its identification here as the frame surrounding a window sash, is intended to define as well a door, such as one framing a window or screen.

Having presented my invention what I believe to be the best mode for acquiring the earlier mentioned attributes, I commend it to those in the field consistent with the hereinafter appended claims.

What is claimed is:

1. A protective barrier for installation over a portal comprising in combination:

a frame construct that provides two glazing faces defining an obverse glazing face and a reverse glazing face, the construct including at least four rigid frame members being hollow at least at the ends thereof, said frame members joined by four joiner members that are adapted with projecting legs for partial insertion into a hollow end of any said frame member, each said frame member having a cross-section shaped as a quadrilateral that projects therefrom a T member defined by a straight element that projects two opposed and essentially orthogonal arms, each said frame member joiner-connected to another frame member to form said construct so that the quadrilateral forms the outermost periphery of the construct and each said glazing face has a continuous, facially peripheral groove that is formed by one arm and the straight element of said T member and a side of said quadrilateral, each said groove receptive of a spline therein;

a first spline means afixed within the groove on the reverse glazing face, said first spline means securing a flexible barrier within said groove; a sealing means, said sealing means comprising a second spline means being located within and protruding from said groove on said obverse glazing face; and construct securing means for removably and sealably fixing the construct to said portal.

2. The barrier of claim 1 wherein said joiner members are elements from which project at least two legs, each said leg being insertable into any hollow end of one of said frame members.

3. The barrier of claim 2 wherein said first and second spline means are constructed of compressible, resilient material.

4. The barrier of claim 1 wherein said securing means is a set of portal-mounted clamping members.

5. The barrier of claim 4 wherein said clamping members comprise dogging apparatus.

6. The barrier of claim 1 wherein said securing means comprises screws.

7. A portal/window covering comprising the combination of:

a frame comprised of a plurality of peripheral members cojoined in a portal/window-conforming geometry by a plurality of joiner elements, each of said plurality of peripheral members defining, in cross section, a quadrilateral for abutting emplacement in a portal/window opening and which projects a T shaped extension inward of said frame, the extension defined by a straight element terminating in two orthogonal, opposed arms, each of said plurality of joiner elements defining a base element including at least two legs, the frame defining an obverse glazing face and a reverse glazing face and having on each a peripheral, continuous grooving formed adjacent to each of said arms;

compressible oversize spline means disposable in the continous grooving and securing a flexible glazing element to at least one of said glazing faces, the oversize spline means protruding from said continuous groove;

sealing means on the periphery of at least one of said glazing faces; and securing devices to removably and fixedly position said covering to said portal/window.

8. The covering of claim 7 wherein said spline means and said sealing means are provided in combination by a resilient element that protrudes from said at least one of said glazing faces.

9. A window/portal adjunct having two faces each of which is adapted to receive thereon a glazing means and comprising in combination at least one flexible, planar barrier means peripherally attached by a compressible oversize spline to a continuous, facial groove positioned in each of said two faces, the groove formed by connecting a plurality of frame members each of which in geometric cross section is a quadrilateral that projects therefrom a T member formed of two oppositely projecting flanges disposed at the end of a straight element, said frame members connected by a joiner means to form a framework geometry identical to a window/portal, the compressible oversize spline protruding from said facial groove, the adjunct further comprising securement means for removably disposing it at said window/portal, and a first of two sealing means conterminous to the outside periphery of said framework geometry and disposable between it and a frame of the window/portal.

10. The adjunct of claim 9 wherein each of said plurality of joiner means defines a base element that projects therefrom at least two legs.

11. The adjunct of claim 9 wherein said securement means comprises screw or dogging devices for removably fixing the adjunct to said window/portal opening.

12. The adjunct of claim 11 further comprising a second of said two sealing means defined by said compressible spline that is used to attach said at least one barrier means, said spline being oversized to protrude from said groove and form an air-tight seal between its glazing face and said frame of the window/portal.

13. The adjunct of claim 9 wherein said barrier means is a mesh or netting fabric.

14. The adjunct of claim 9 wherein said barrier means is a membrane.

* * * * *